US007145762B2

(12) United States Patent
Nerheim

(10) Patent No.: US 7,145,762 B2
(45) Date of Patent: Dec. 5, 2006

(54) SYSTEMS AND METHODS FOR IMMOBILIZING USING PLURAL ENERGY STORES

(75) Inventor: Magne Nerheim, Scottsdale, AZ (US)

(73) Assignee: Taser International, Inc., Scottsdale, AZ (US)

( * ) Notice: Subject to any disclaimer, the term of this patent is extended or adjusted under 35 U.S.C. 154(b) by 454 days.

(21) Appl. No.: 10/364,164

(22) Filed: Feb. 11, 2003

(65) Prior Publication Data

US 2004/0156162 A1 Aug. 12, 2004

(51) Int. Cl.
*F41C 9/00* (2006.01)

(52) U.S. Cl. ..... 361/323; 42/1.08

(58) Field of Classification Search ..... 361/230, 361/231, 232; 363/107, 109, 120; 463/47.3, 463/47.4; 42/1.08; 102/502
See application file for complete search history.

(56) References Cited

U.S. PATENT DOCUMENTS 2,805,067 A 9/1957 Ryan
2,896,123 A 7/1959 McNutlty
3,223,887 A 12/1965 Brown
3,376,470 A 4/1968 Stone
3,450,942 A 6/1969 Segall et al.
3,523,538 A 8/1970 Shimizu
3,569,727 A 3/1971 Aggarwal
3,584,929 A 6/1971 Schuette
3,626,626 A 12/1971 Blanc
3,629,652 A 12/1971 Maycock
3,717,802 A 2/1973 Plevy et al.
3,803,463 A * 4/1974 Cover ..... 361/232
3,819,108 A 6/1974 Jordon
3,958,168 A 5/1976 Grundberg
3,972,315 A 8/1976 Munden
4,004,561 A 1/1977 Thieme
4,027,198 A 5/1977 Linkroum
4,040,425 A * 8/1977 Goodling et al. ..... 606/164
4,092,695 A 5/1978 Henderson et al.
4,120,305 A 10/1978 Rhoads et al.
4,129,895 A 12/1978 Witting
4,154,205 A 5/1979 Forster (Continued)

FOREIGN PATENT DOCUMENTS

EP 0228840 7/1991

(Continued)

OTHER PUBLICATIONS

"Stun Guns—An Independent Report," T'Prina Technology, 1994, published by T'Prina Technology, Gateway Station, Aurora, CO 80044-1126 USA.

*Primary Examiner*—Brian Sircus
*Assistant Examiner*—Danny Nguyen

(57) ABSTRACT

An electronic disabling device includes first and second electrodes positionable to establish first and second spaced apart contact points on a target having a high impedance air gap existing between at least one of the electrodes and the target. The power supply generates a first high voltage, short duration output across the first and second electrodes during a first time interval to ionize air within the air gap to thereby reduce the high impedance across the air gap to a lower impedance to enable current flow across the air gap at a lower voltage level. The power supply next generates a second lower voltage, longer duration output across the first and second electrodes during a second time interval to maintain the current flow across the first and second electrodes and between the first and second contact points on the target to enable the current flow through the target to cause involuntary muscle contractions to thereby immobilize the target.

108 Claims, 13 Drawing Sheets

Two-Stage Shaped Pulse Circuit

U.S. PATENT DOCUMENTS 4,162,515 A 7/1979 Henderson et al.
4,167,036 A 9/1979 Kenney
4,242,715 A 12/1980 Laird
4,253,132 A 2/1981 Cover
4,370,696 A 1/1983 Darrell
4,486,807 A 12/1984 Yanez
4,510,915 A 4/1985 Ishikawa et al.
4,539,937 A 9/1985 Workman
4,541,191 A 9/1985 Morris et al.
4,589,398 A 5/1986 Pate et al.
4,613,797 A * 9/1986 Eggers et al. ..... 315/241 R
4,688,140 A 8/1987 Hammes
4,691,264 A 9/1987 Schaffhauser et al.
4,843,336 A 6/1989 Kuo
4,846,044 A 7/1989 Lahr
4,859,868 A * 8/1989 McKissack ..... 307/106
4,872,084 A 10/1989 Dunning et al.
4,900,990 A 2/1990 Sikora
4,949,017 A 8/1990 Sikora
5,078,117 A 1/1992 Cover
5,163,411 A 11/1992 Koiwa
5,178,120 A 1/1993 Howson et al.
5,193,048 A 3/1993 Kaufman et al.
5,215,066 A 6/1993 Narishige
5,225,623 A 7/1993 Krasnow
5,282,332 A 2/1994 Philips
5,317,155 A 5/1994 King
5,388,603 A 2/1995 Bauer et al.
5,467,247 A 11/1995 de Anda et al.
5,471,362 A 11/1995 Gowan
5,473,501 A 12/1995 Claypool
5,571,362 A 11/1996 Hachey et al.
5,625,525 A 4/1997 Coakley et al.
5,654,868 A 8/1997 Buer
5,698,815 A 12/1997 Ragner
5,754,011 A * 5/1998 Frus et al. ..... 315/209 SC
5,891,172 A * 4/1999 Stendahl et al. ..... 607/5
5,962,806 A 10/1999 Coakley et al.
5,973,477 A 10/1999 Chang
6,022,120 A 2/2000 Chang
6,204,476 B1 3/2001 Reynolds
6,404,613 B1 6/2002 Dowling et al.
6,636,412 B1 10/2003 Smith
6,643,114 B1 11/2003 Stethem
6,791,816 B1 * 9/2004 Stethem ..... 361/232

FOREIGN PATENT DOCUMENTS

FR 2317804 3/1977
GB 1109052 4/1968
GB 1239756 7/1971
GB 2085523 4/1982

* cited by examiner

Conventional Stun Gun Circuit

Two-Stage Shaped Pulse Circuit

Drawing Sheet 11 of 13

Voltage across C1, C2 and C3 during T2 to T3

Voltage across GAP2 and load (E1 to E2) during T2 to T3

| Interval Number | TIME | GAP1 | GAP 2 |
|---|---|---|---|
| 1 | $T_0 - T_1$ | OFF | OFF |
| 2 | $T1 - T_2$ | ON | OFF |
| 3 | $T_2 - T_3$ | OFF | ON |
| 4 | $T_3 - T_4$ | OFF | OFF |

SPARK Gap ON/OFF Timing

SYSTEMS AND METHODS FOR IMMOBILIZING USING PLURAL ENERGY STORES

BACKGROUND OF THE INVENTION

1. Field of the Invention

The present invention relates to electronic disabling devices, and more particularly, to electronic disabling devices which generate a time-sequenced, shaped voltage waveform output signal.

2. Description of the Prior Art

The original stun gun was invented in the 1960's by Jack Cover. Such prior art stun guns incapacitated a target by delivering a sequence of high voltage pulses into the skin of a subject such that the current flow through the subject essentially "short-circuited" the target's neuromuscular system causing a stun effect in lower power systems and involuntary muscle contractions in more powerful systems. Stun guns, or electronic disabling devices, have been made in two primary configurations. A first stun gun design requires the user to establish direct contact between the first and second stun gun output electrodes and the target. A second stun gun design operates on a remote target by launching a pair of darts which typically incorporate barbed pointed ends. The darts either indirectly engage the clothing worn by a target or directly engage the target by causing the barbs to penetrate the target's skin. In most cases, a high impedance air gap exists between one or both of the first and second stun gun electrodes and the skin of the target because one or both of the electrodes contact the target's clothing rather than establishing a direct, low impedance contact point with the target's skin.

One of the most advanced existing stun guns incorporates the circuit concept illustrated in the FIG. 1 schematic diagram. Closing safety switch S1 connects the battery power supply to a microprocessor circuit and places the stun gun in the "armed" and ready to fire configuration. Subsequent closure of the trigger switch S2 causes the microprocessor to activate the power supply which generates a pulsed voltage output on the order of two thousand volts which is coupled to charge an energy storage capacitor up to the two thousand volt power supply output voltage. Spark gap "Gap 1" periodically breaks down, causing a high current pulse through transformer T1 which transforms the two thousand volt input into a fifty thousand volt output pulse.

Taser International of Scottsdale, Ariz., the assignee of the present invention, has for several years manufactured sophisticated stun guns of the type illustrated in the FIG. 1 block diagram designated as the Taser® Model M18 and Model M26 stun guns. High power stun guns such as these Taser International products typically incorporate an energy storage capacitor having a capacitance rating of from 0.2 microfarads at two thousand volts on a light duty weapon up to 0.88 microFarads at two thousand volts as used on the Taser M18 and M26 stun guns.

After the trigger switch S2 is closed, the high voltage power supply begins charging the energy storage capacitor up to the two thousand volt power supply peak output voltage. When the power supply output voltage reaches the two thousand voltage spark gap breakdown voltage. A spark is generated across the spark gap designated as "Gap 1." Ionization of the spark gap reduces the spark gap impedance from a near infinite impedance level to a near zero impedance and allows the energy storage capacitor to almost fully discharge through step up transformer T1. As the output voltage of the energy storage capacitor rapidly decreases from the original two thousand volt level to a much lower level, the current flow through the spark gap decreases toward zero causing the spark gap to deionize and to resume its open circuit configuration with a near infinite impedance. This "reopening" of the spark gap defines the end of the first fifty thousand volt output pulse which is applied to output electrodes designated in FIG. 1 as "E1" and "E2." A typical stun gun of the type illustrated in the FIG. 1 circuit diagram produces from five to twenty pulses per second.

Because a stun gun designer must assume that a target may be wearing an item of clothing such as a leather or cloth jacket which functions to establish a one quarter inch to one inch air gap between stun gun electrodes E1 and E2 and the target's skin, stun guns have been required to generate fifty thousand volt output pulses because this extreme voltage level is capable of establishing an arc across the high impedance air gap which may be presented between the stun gun output electrodes E1 and E2 and the target's skin. As soon as this electrical arc has been established, the near infinite impedance across the air gap is promptly reduced to a very low impedance level which allows current to flow between the spaced apart stun gun output electrodes E1 and E2 and through the target's skin and intervening tissue regions. By generating a significant current flow within the target across the spaced apart stun gun output electrodes, the stun gun essentially short circuits the target's electromuscular control system and induces severe muscular contractions. With high power stun guns, such as the Taser M18 and M26 stun guns, the magnitude of the current flow across the spaced apart stun gun output electrodes causes numerous groups of skeletal muscles to rigidly contract. By causing high force level skeletal muscle contractions, the stun gun causes the target to lose its ability to maintain an erect, balanced posture. As a result, the target falls to the ground and is incapacitated.

The "M26" designation of the Taser stun gun reflects the fact that, when operated, the Taser M26 stun gun delivers twenty-six watts of output power as measured at the output capacitor. Due to the high voltage power supply inefficiencies, the battery input power is around thirty-five watts at a pulse rate of fifteen pulses per second. Due to the requirement to generate a high voltage, high power output signal, the Taser M26 stun gun requires a relatively large and relatively heavy eight AA cell battery pack. In addition, the M26 power generating solid state components, its energy storage capacitor, step up transformer and related parts must function either in a high current relatively high voltage mode (two thousand volts) or be able to withstand repeated exposure to fifty thousand volt output pulses.

At somewhere around fifty thousand volts, the M26 stun gun air gap between output electrodes E1 and E2 breaks down, the air is ionized, a blue electric arc forms between the electrodes and current begins flowing between electrodes E1 and E2. As soon as stun gun output terminals E1 and E2 are presented with a relatively low impedance load instead of the high impedance air gap, the stun gun output voltage will drop to a significantly lower voltage level. For example, with a human target and with about a ten inch probe to probe separation, the output voltage of a Taser Model M26 might drop from an initial high level of fifty-five thousand volts to a voltage on the order of about five thousand volts. This rapid voltage drop phenomenon with even the most advanced conventional stun guns results because such stun guns are tuned to operate in only a single mode to consistently create an electrical arc across a very high, near infinite impedance air gap. Once the stun gun output electrodes actually form a direct low impedance circuit across the spark gap, the effective stun gun load impedance decreases to the target impedance-typically a level on the order of one thousand Ohms or less. A typical human subject frequently presents a load impedance on the order of about two hundred Ohms.

Conventional stun guns have by necessity been designed to have the capability of causing voltage breakdown across a very high impedance air gap. As a result, such stun guns have been designed to produce a fifty thousand to sixty thousand volt output. Once the air gap has been ionized and the air gap impedance has been reduced to a very low level, the stun gun, which has by necessity been designed to have the capability of ionizing an air gap, must now continue operating in the same mode while delivering current flow or charge across the skin of a now very low impedance target. The resulting high power, high voltage stun gun circuit operates relatively inefficiently yielding low electro-muscular efficiency and with high battery power requirements.

SUMMARY OF THE INVENTION

Briefly stated, and in accord with one embodiment of the invention, an electronic disabling device includes first and second electrodes positioned to establish first and second spaced apart contact points on a target wherein a high impedance air gap may exist between at least one of the electrodes and the target. The electronic disabling device includes a power supply for generating a first high voltage, short duration output across the first and second electrodes during the first time interval to ionize the air within the air gap to thereby reduce the high impedance across the air gap to a lower impedance to enable current flow across the air gap at a lower voltage level and for subsequently generating a second lower voltage, longer duration output across the first and second electrodes during a second time interval to maintain the current flow across the first and second electrodes and between the first and second contact points on the target to enable the current flow through the target to cause involuntary muscle contractions to thereby immobilize the target.

DESCRIPTION OF THE DRAWINGS

The invention is pointed out with particularity in the appended claims. However, other objects and advantages together with the operation of the invention may be better understood by reference to the following detailed description taken in connection with the following illustrations, wherein:

DESCRIPTION OF THE PREFERRED EMBODIMENT

In order to better illustrate the advantages of the invention and its contributions to the art, a preferred embodiment of the invention will now be described in detail.

Figure 2:
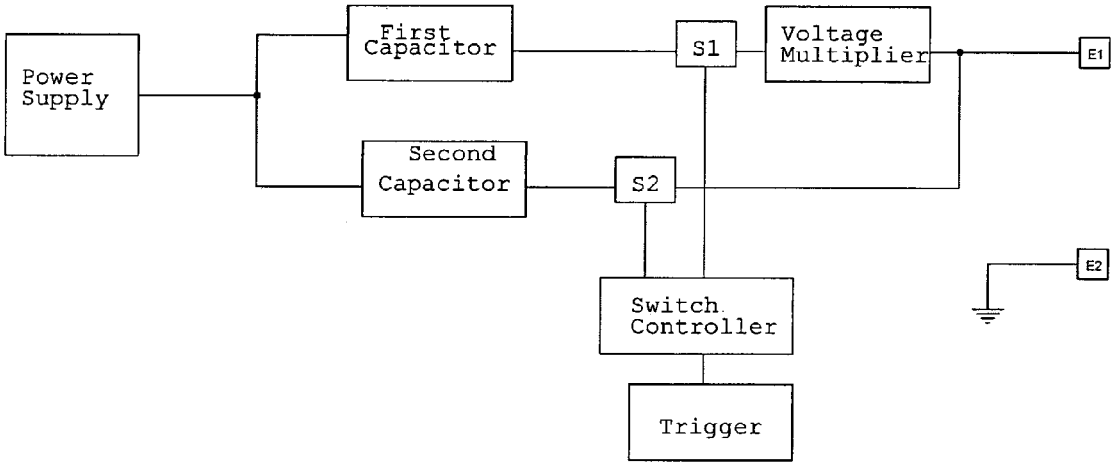
FIG. 2 represents a block diagram illustration of one embodiment of the present invention.

Referring now to FIG. 2, an electronic disabling device for immobilizing a target according to the present invention includes a power supply, first and second energy storage capacitors, and switches S1 and S2 which operate as single pole, single throw switches and serve to selectively connect the two energy storage capacitors to down stream circuit elements. The first energy storage capacitor is selectively connected by switch S1 to a voltage multiplier which is coupled to first and second stun gun output electrodes designated E1 and E2. The first leads of the first and second energy storage capacitors are connected in parallel with the power supply output. The second leads of each capacitor are connected to ground to thereby establish an electrical connection with the grounded output electrode E2.

The stun gun trigger controls a switch controller which controls the timing and closure of switches S1 and S2.

Referring now to FIGS. 3–8 and FIG. 12, the power supply is activated at time T0. The energy storage capacitor charging takes place during time interval T0–T1 as illustrated in FIGS. 12A and 12B.

At time T1, switch controller closes switch S1 which couples the output of the first energy storage capacitor to the voltage multiplier. The FIG. 3B and FIG. 6 voltage versus time graphs illustrate that the voltage multiplier output rapidly builds from a zero voltage level to a level indicated in the FIG. 3B and FIG. 6 graphics as "$V_{HIGH}$."

Figure 5A:
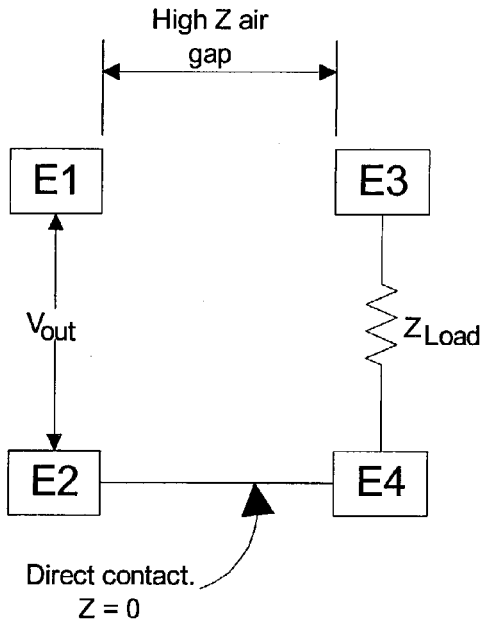
FIG. 5A illustrates a high impedance air gap which may exist between one of the electronic disabling device output electrodes and spaced apart locations on a target illustrated by the designations "E3," "E4," and an intervening load $Z_{LOAD}$.
Figure 5B:
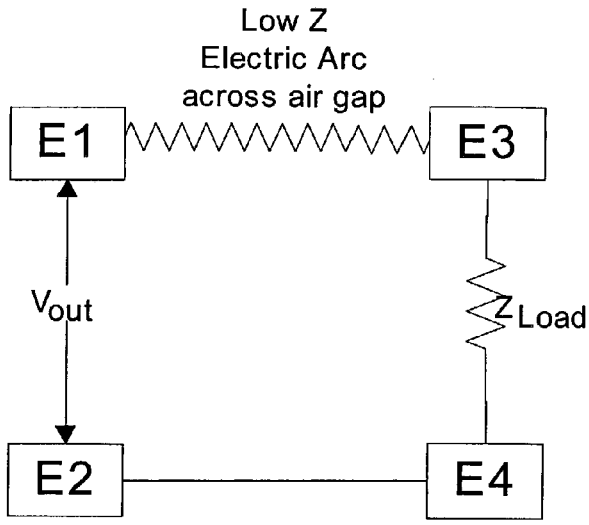
FIG. 5B illustrates the circuit elements shown in FIG. 5A after an electric spark has been created across electrodes E1 and E2 which produces an ionized, low impedance path across the air gap.

In the hypothetical situation illustrated in FIG. 5A, a high impedance air gap exists between stun gun output electrode E1 and target contact point E3. The FIG. 5A diagram illustrates the hypothetical situation where a direct contact (i.e., impedance E2–E4 equals zero) has been established between stun gun electrical output terminal E2 and the second spaced apart contact point E4 on a human target. The E1 to E2 on the target spacing is assumed to equal on the order of ten inches. The resistor symbol and the symbol $Z_{LOAD}$ represents the internal target resistance which is typically less than one thousand Ohms and approximates 200 Ohms for a typical human target.

Application of the $V_{HIGH}$ voltage multiplied output across the E1 to E3 high impedance air gap forms an electrical arc having ionized air within the air gap. The FIG. 5C timing diagram illustrates that after a predetermined time during the T1 to T2 high voltage waveform output interval, the air gap impedance drops from a near infinite level to a near zero level. This second air gap configuration is illustrated in the FIG. 5B drawing.

Once this low impedance ionized path has been established by the short duration application of the $V_{HIGH}$ output signal which resulted from the discharge of the first energy storage capacitor. through the voltage multiplier, the switch controller opens switch S1 and closes switch S2 to directly connect the second energy storage capacitor across the electronic disabling device output electrodes E1 and E2. The circuit configuration for this second time interval is illustrated in the FIG. 4A block diagram. As illustrated in the FIG. 4B voltage waveform output diagram, the relatively low voltage $V_{LOW}$ derived from the second output capacitor is now directly connected across the stun gun output terminals E1 and E2. Because the ionization of the air gap during time interval T1 to T2 dropped the air gap impedance to a low level, application of the relatively low second capacitor voltage "$V_{LOW}$" across the E1 to E3 air gap during time interval T2 to T3 will allow the second energy storage capacitor to continue and maintain the previously initiated discharge across the arced-over air gap for a significant additional time interval. This continuing, lower voltage discharge of the second capacitor during the interval T2 to T3 transfers a substantial amount of target-incapacitating electrical charge through the target.

As illustrated in FIGS. 4B, 5C, 6 and 8, the continuing discharge of the second capacitor through the target will exhaust the charge stored in the capacitor and will ultimately cause the output voltage from the second capacitor to drop to a voltage level at which the ionization within the air gap will revert to the non-ionized, high impedance state causing cessation of current flow through the target.

In the FIG. 2 block diagram, the switch controller can be programmed to close switch S1 for a predetermined period of time and then to close switch S2 for a predetermined period of time to control the T1 to T2 first capacitor discharge interval and the T2 to T3 second capacitor discharge interval.

During the T3 to T4 interval, the power supply will be disabled to maintain a factory present pulse repetition rate. As illustrated in the FIG. 8 timing diagram, this factory present pulse repetition rate defines the overall T0 to T4 time interval. A timing control circuit potentially implemented by a microprocessor maintains switches S1 and S2 in the open condition during the T3 to T4 time interval and disables the power supply until the desired T0 to T4 time interval has been completed. At time T0, the power supply will be reactivated to recharge the first and second capacitors to the power supply output voltage.

Figure 9:
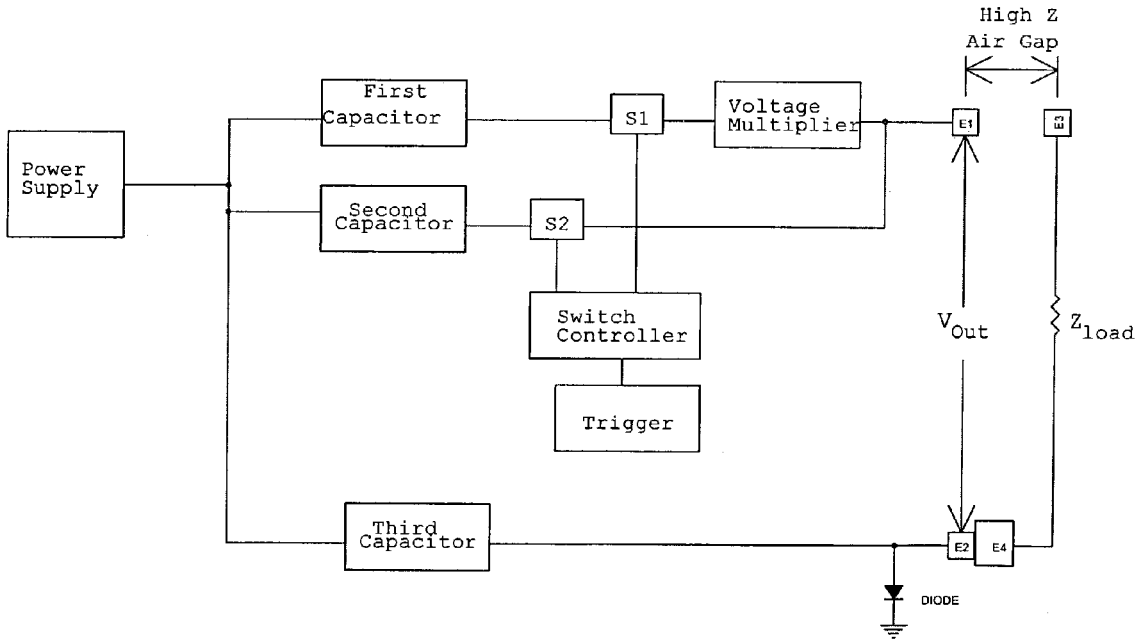
FIG. 9 represents a block diagram illustration of a more complex version of the FIG. 2 circuit where the FIG. 9 circuit includes a third capacitor.

Referring now to the FIG. 9 schematic diagram, the FIG. 2 circuit has been modified to include a third capacitor and a load diode (or resistor) connected as shown. The operation of this enhanced circuit diagram will be explained below in connection with FIG. 10 and the related more detailed schematic diagrams.

Figure 10:
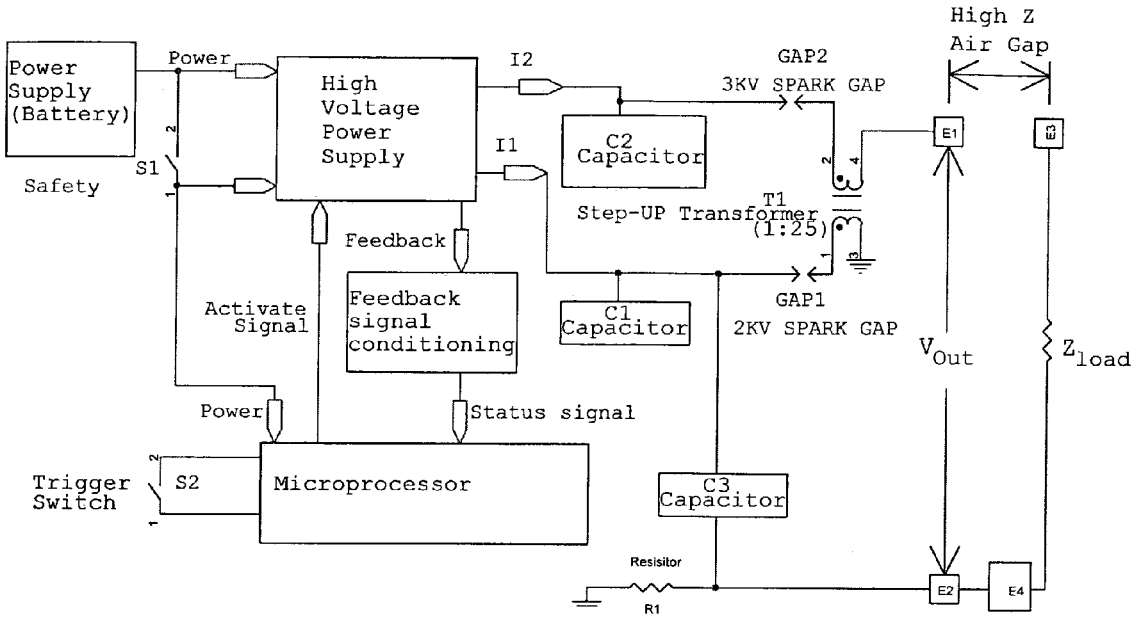
FIG. 10 represents a more detailed schematic diagram of the FIG. 9 circuit.

Referring now to the FIG. 10 electrical schematic diagram, the high voltage power supply generates an output current I1 which charges capacitors C1 and C3 in parallel. While the second terminal of capacitor C2 is connected to ground, the second terminal of capacitor C3 is connected to ground through a relatively low resistance load resistor R1 or as illustrated in FIG. 9 by a diode. The first voltage output of the high voltage power supply is also connected to a two thousand volt spark gap designated as "Gap 1" and to the primary winding of an output transformer having a one to twenty-five primary to secondary winding step up ratio.

The second equal voltage output of the high voltage power supply is connected to one terminal capacitor C2 while the second capacitor terminal is connected to ground. The second power supply output terminal is also connected to a three thousand volt spark gap designated G2. The second side of spark gap G2 is connected in series with the secondary winding of transformer T1 and to stun gun output terminal E1.

In the FIG. 10 circuit, closure of safety switch S1 enables operation of the high voltage power supply and places the stun gun into a standby/ready to operate configuration. Closure of the trigger switch designated S2 causes the microprocessor to send a control signal to the high voltage power supply which activates the high voltage power supply and causes it to initiate current flow I1 into capacitors C1 and C3 and current flow I2 into capacitor C2. This capacitor charging time interval will now be explained in connection with the simplified FIG. 11 block diagram and in connection with the FIG. 12A and FIG. 12B voltage versus time graphs.

Figure 11:
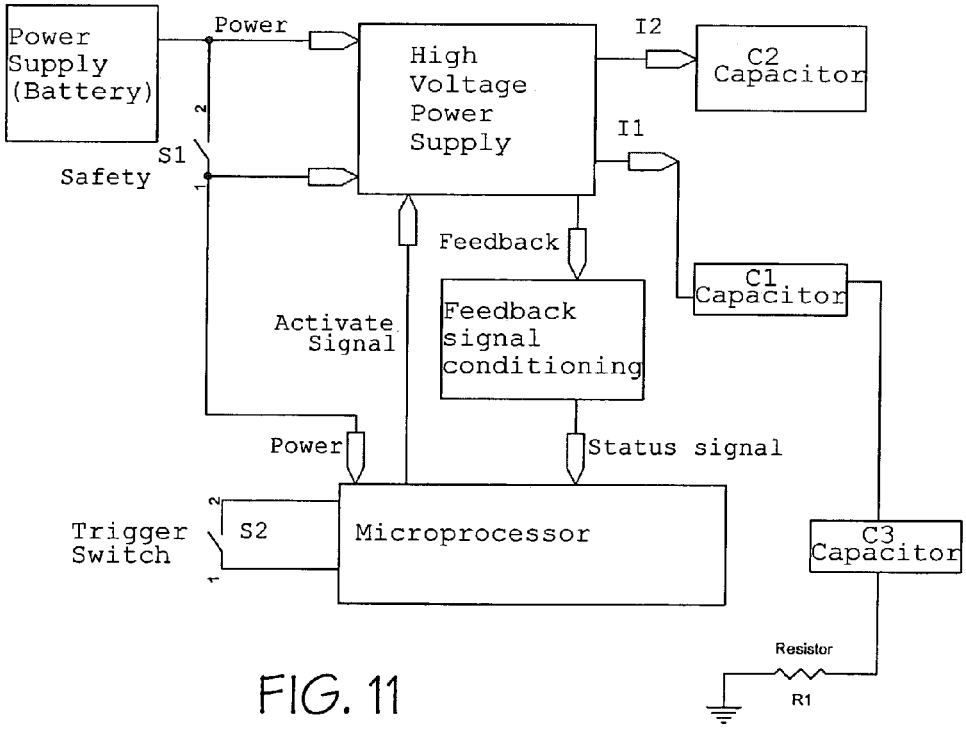
FIG. 11 represents a simplified block diagram of the FIG. 10 circuit showing the active components during time interval T0 to T1.
Figure 12A:
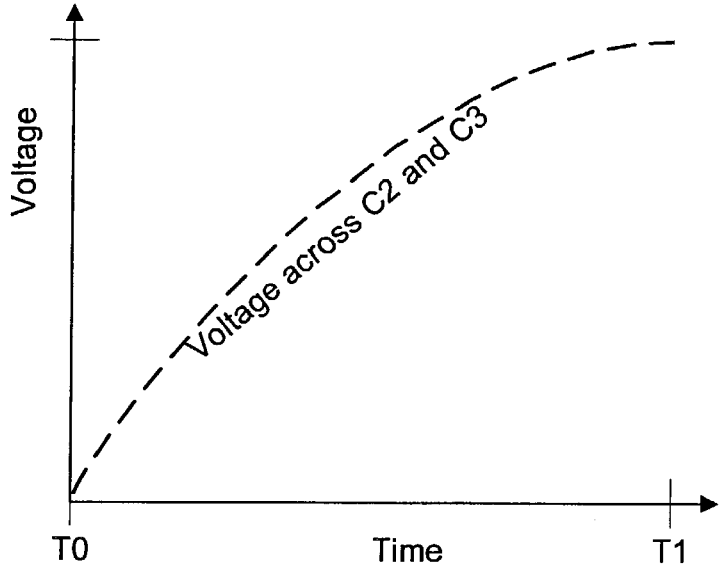
FIGS. 12A and B represent timing diagrams illustrating the voltages across capacitor C1, C2 and C3 during time interval T0 to T1.
Figure 12B:
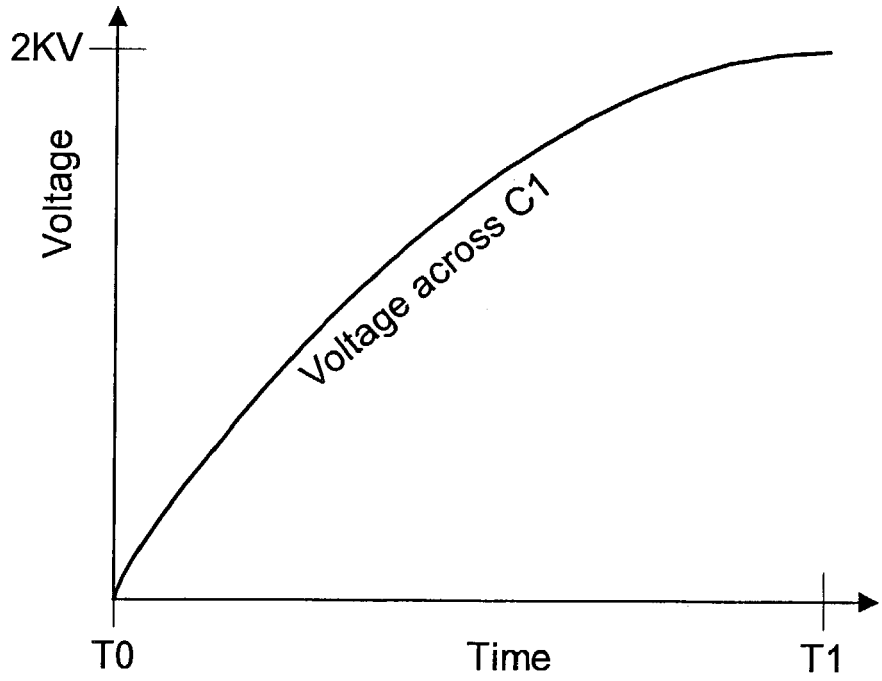

During the T0 to T1 capacitor charging interval illustrated in FIGS. 11 and 12, capacitors C1, C2 and C3 begin charging from a zero voltage up to the two thousand volt output generated by the high voltage power supply. Spark gaps Gap 1 and Gap 2 remain in the open, near infinite impedance configuration because only at the end of the T0 to T1 capacitor charging interval will the C1/C2 capacitor output voltage approach the two thousand volt breakdown rating of Gap 1.

Figure 13:
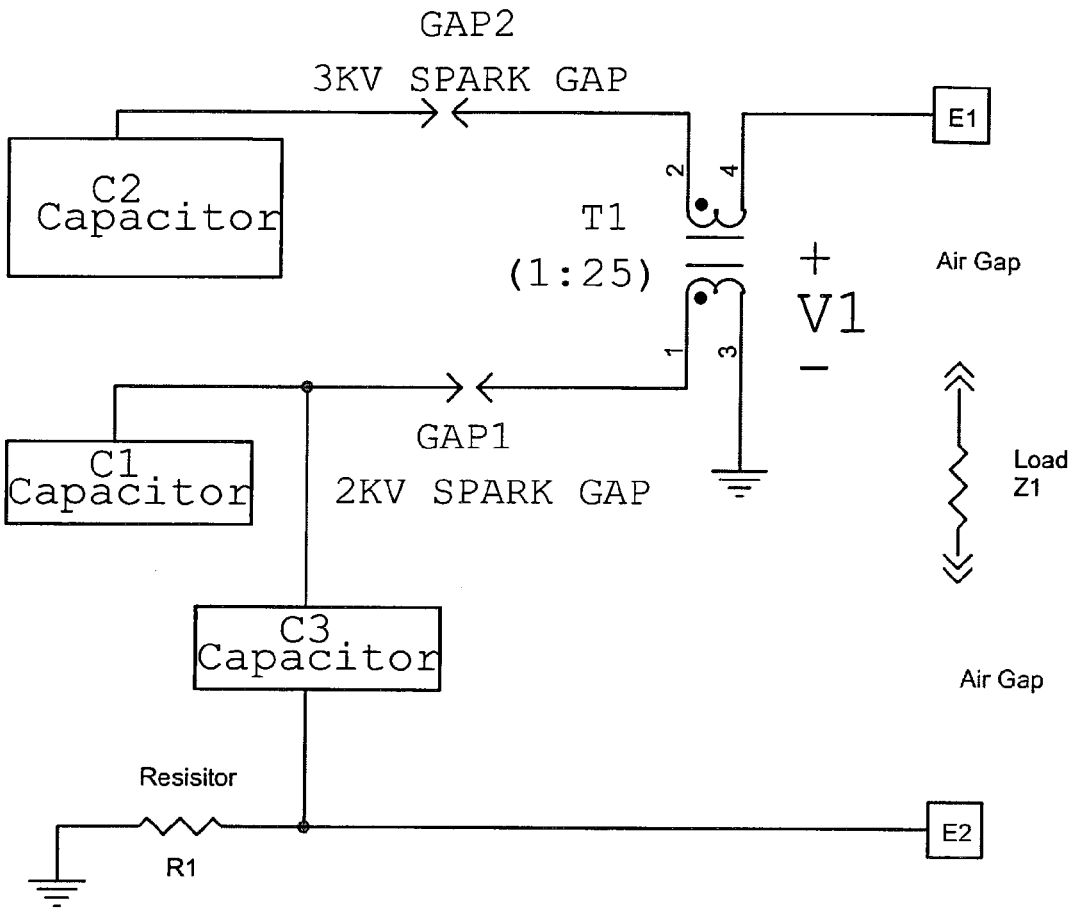
FIG. 13 illustrates the operating configuration of the FIG. 11 circuit during the T1 to T2 time interval.
Figure 14A:
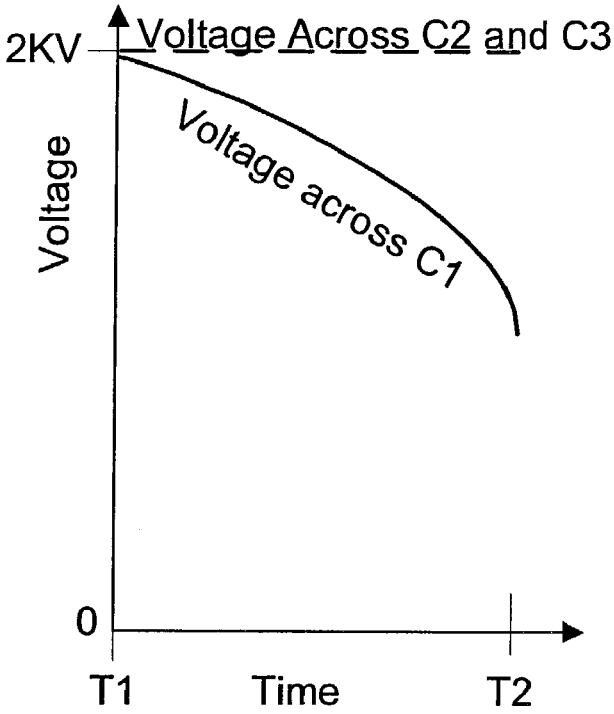
FIGS. 14A and B illustrate the voltages across capacitors C1, C2 and C3 during the T1 to T2 time interval.
Figure 14B:
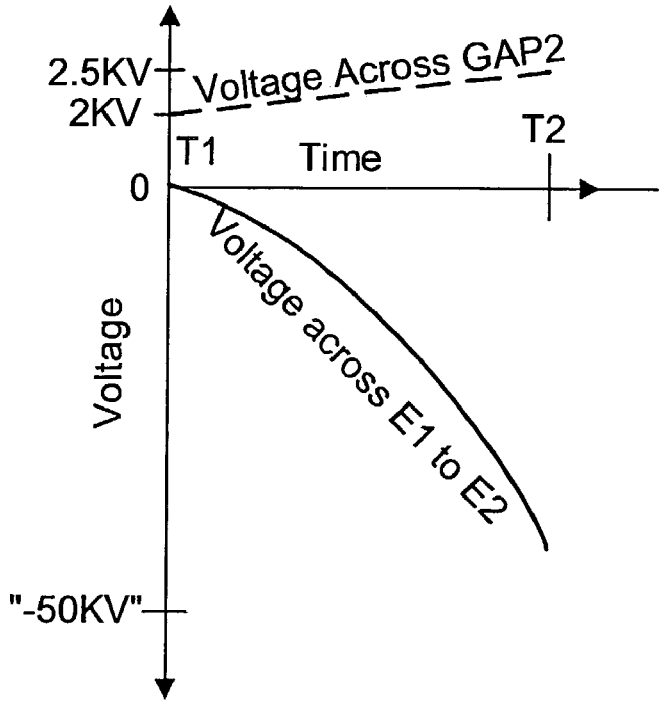

Referring now to FIGS. 13 and 14, as the voltage on capacitors C1 and C2 reaches the two thousand volt breakdown voltage of spark gap G1, a spark will be formed across the spark gap and the spark gap impedance will drop to a near zero level. This transition is indicated in the FIG. 14 timing diagrams as well as in the more simplified FIG. 3B and FIG. 6 timing diagrams. Beginning at time T1, capacitor C1 will begin discharging through the primary winding of transformer T1 which will rapidly ramp up the E1 to E2 secondary winding output voltage to negative fifty thousand volts as shown in FIG. 14B. FIG. 14A illustrates that the voltage across capacitor C1 relatively slowly decreases from the original two thousand volt level while the FIG. 14B timing diagram illustrates that the multiplied voltage on the secondary winding of transformer T1 will rapidly build up during the time interval T1 to T2 to a voltage approaching minus fifty thousand volts.

Figure 15:
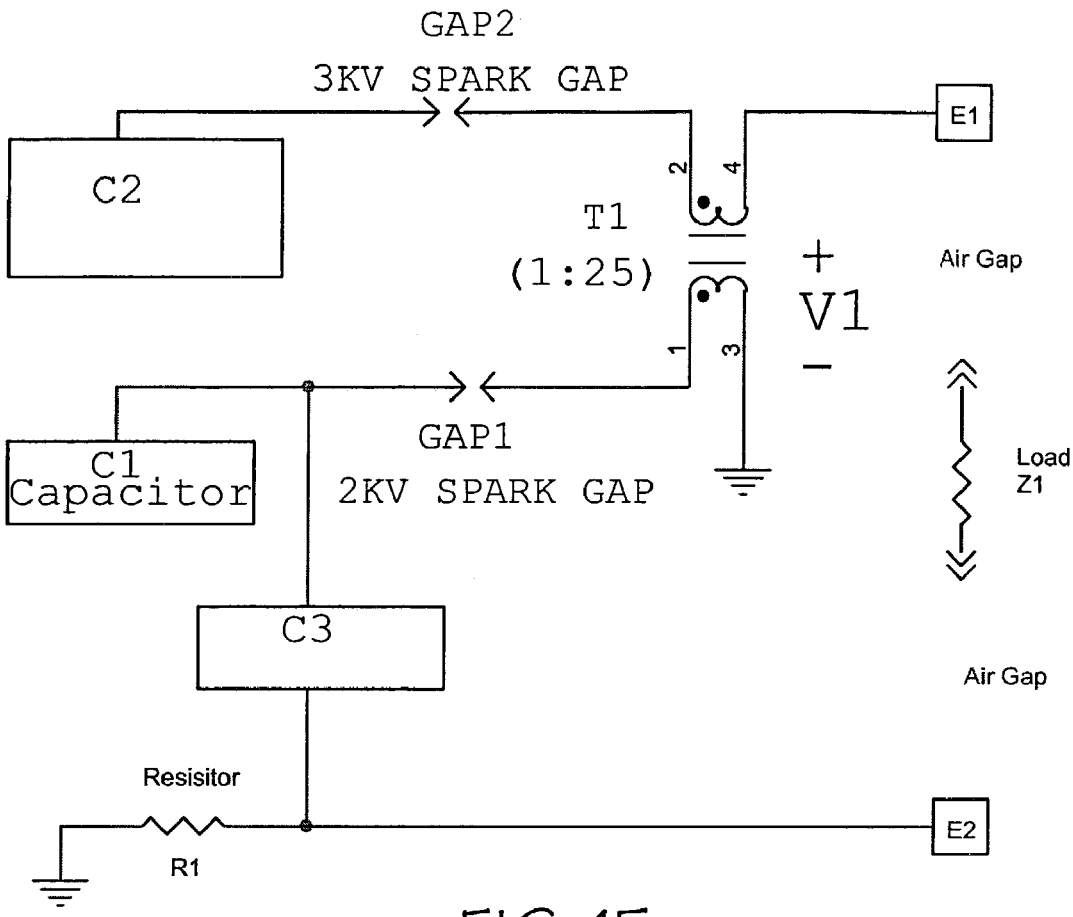
FIG. 15 represents a schematic diagram of the active components of the FIG. 10 circuit during time interval T2 to T3.
Figure 16:
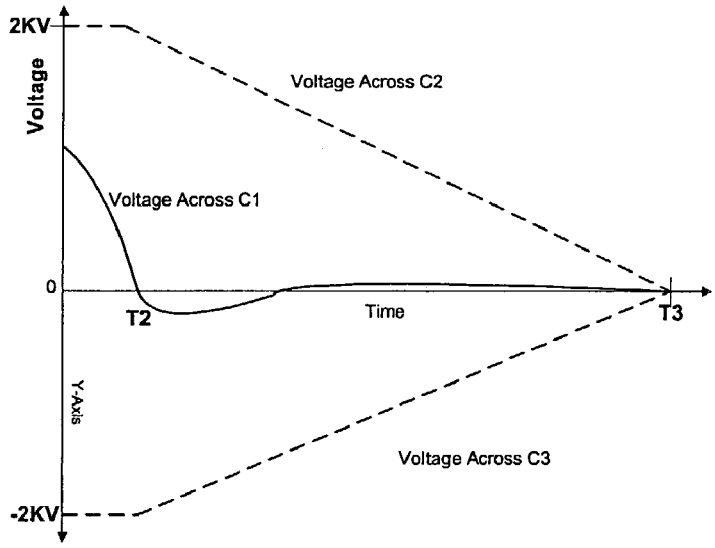
FIG. 16 illustrates the voltages across capacitors C1, C2 and C3 during time interval T2 to T3.

At the end of the T2 time interval, the FIG. 10 circuit transitions into the second configuration where the three thousand volt Gap 2 spark gap has been ionized into a near zero impedance level allowing capacitors C2 and C3 to discharge across stun gun output terminals E1 and E2 through the relatively low impedance load target. Because as illustrated in the FIG. 16 timing diagram, the voltage across C1 will have discharged to a near zero level as time approaches T2, the FIG. 15 simplification of the FIG. 10 circuit diagram which illustrates the circuit configuration during the T2 to T3 time interval shows that capacitor C1 has effectively and functionally been taken out of the circuit. As illustrated by the FIG. 16 timing diagram, during the T2 to T3 time interval, the voltage across capacitors C2 and C3 decreases to zero as these capacitors discharge through the now low impedance (target only) load seen across output terminals E1 and E2.

Figures 17, 18:
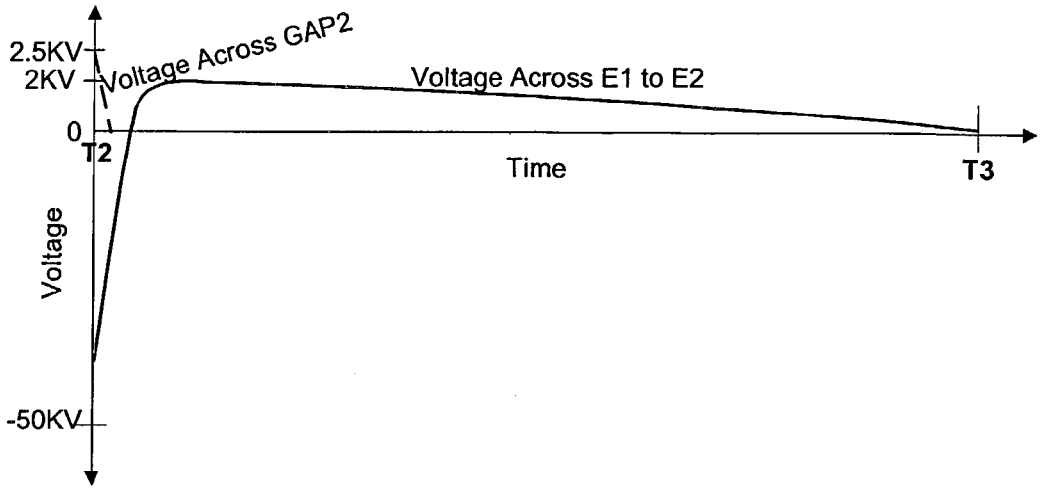
FIG. 17 illustrates the voltage levels across Gap 2 and E1 to E2 during time interval T2 to T3.
FIG. 18 represents a chart indicating the effective impedance level of Gap 1 and Gap 2 during the various time intervals relevant to the operation of the present invention.

FIG. 17 represents another timing diagram illustrating the voltage across Gap 2 and the voltage across stun gun output terminals E1 and E2 during the T2 to T3 time interval.

Figure 4B:
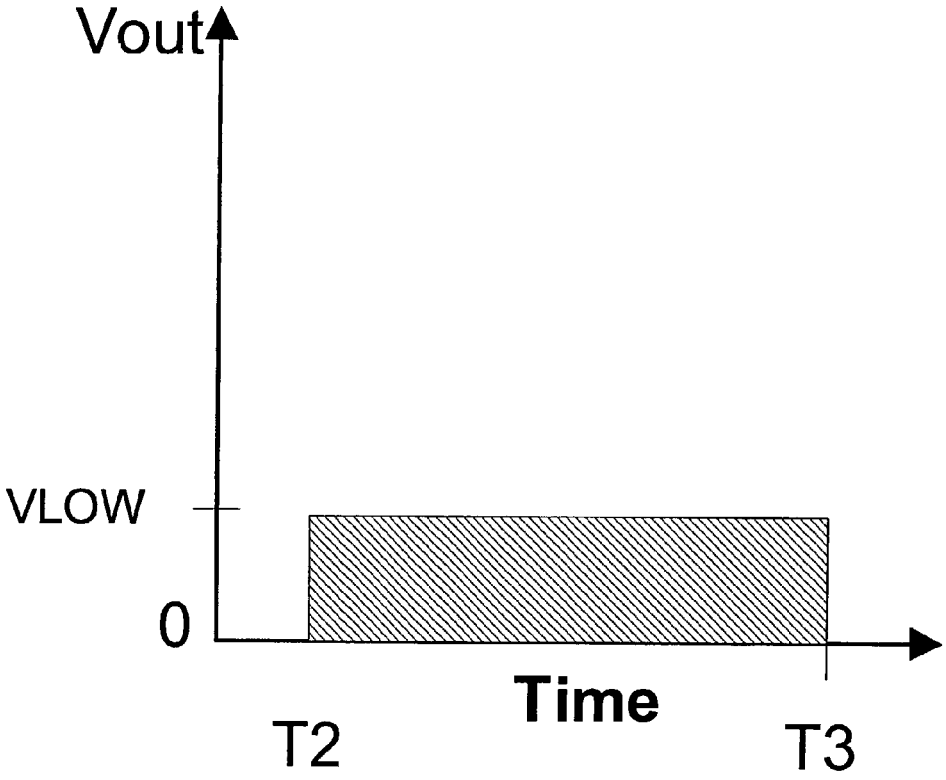
FIG. 4B represents a graph illustrating a generalized output voltage waveform for the FIG. 4A circuit element during the second time interval.
Figure 5C:
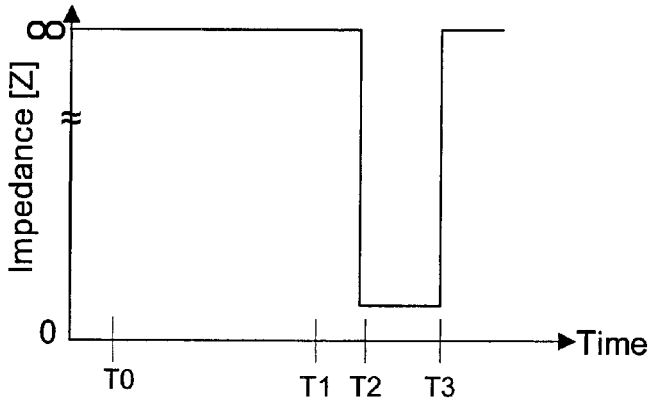
FIG. 5C represents a graph illustrating the high impedance to low impedance configuration charge across the air gap caused by transition from the FIG. 5A circuit configuration into the FIG. 5B (ionized) circuit configuration.
Figure 6:
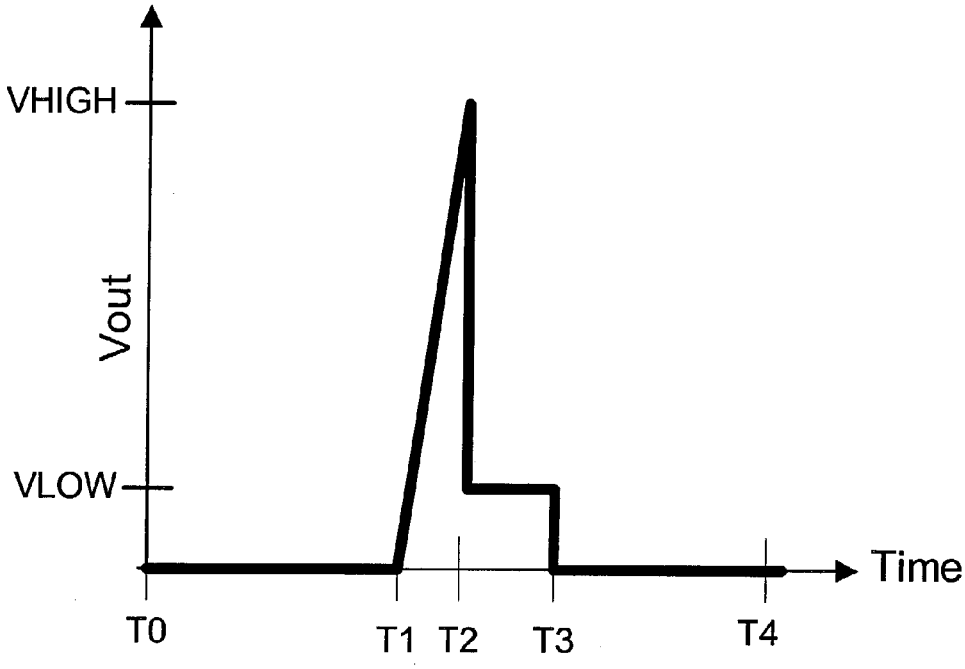
FIG. 6 illustrates a graphic representation of a plot of voltage versus time for the FIG. 2 circuit diagram.
Figure 7:
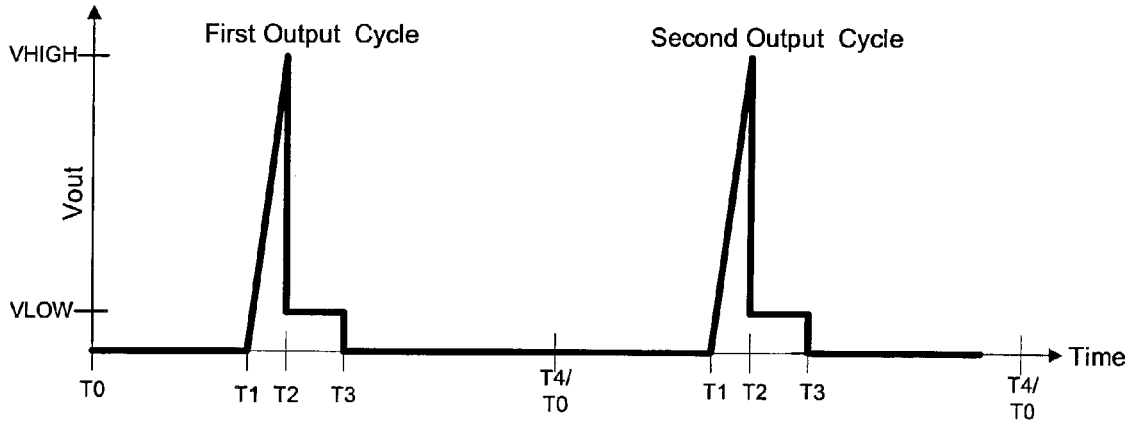
FIG. 7 illustrates a pair of sequential output pulses corresponding to two of the output pulses of the type illustrated in FIG. 6.

In one preferred embodiment of the FIG. 10 circuit, capacitor C1, the discharge of which provides the relatively high energy level required to ionize the high impedance air gap between E1 and E3, can be implemented with a capacitor rating of 0.14 microFarads and two thousand volts. As previously discussed, capacitor C1 operates only during time interval T1 to T2 which, in this preferred embodiment, approximates on the order of 1.5 microseconds in duration. Capacitors C2 and C3 in one preferred embodiment may be selected as 0.02 microFarad capacitors for a two thousand power supply voltage and operate during the T2 to T3 time interval to generate the relatively low, voltage output as illustrated in FIG. 4B to maintain the current flow through the now low impedance dart-to-target air gap during the T2 to T3 time interval as illustrated in FIG. 5C. In this particular preferred embodiment, the duration of the T2 to T3 time interval approximates 50 microseconds.

Due to many variables, the duration of the T0 to T1 time interval charge. For example, a fresh battery may shorten the T0 to T1 time interval in comparison to circuit operation with a partially discharged battery. Similarly, operation of the stun gun in cold weather which degrades battery capacity might also increase the T0 to T1 time interval.

Figure 8:
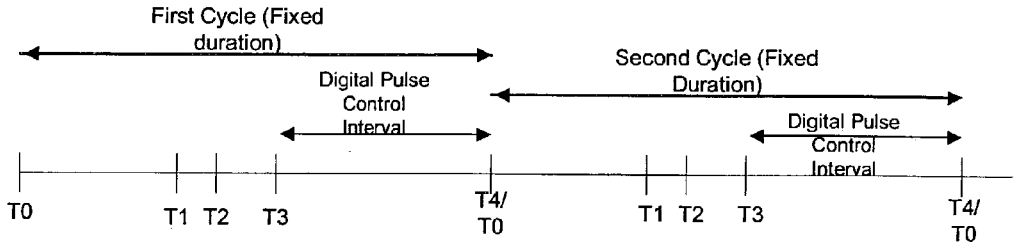
FIG. 8 illustrates a sequence of two output pulses.

Since it is highly desirable to operate stun guns with a fixed pulse repetition rate as illustrated in the FIG. 8 timing diagram, the circuit of the present invention provides a microprocessor-implemented digital pulse control interval designated as the T3 to T4 interval in FIG. 8. As illustrated in the FIG. 10 block diagram, the microprocessor receives a feedback signal from the high voltage power supply via a feedback signal conditioning element which provides a circuit operating status signal to the microprocessor. The microprocessor is thus able to detect when time T3 has been reached as illustrated in the FIG. 6 timing diagram and in the FIG. 8 timing diagram. Since the commencement time T0 of the operating cycle is known, the microprocessor will maintain the high voltage power supply in a shut down or disabled operating mode from T3 until the factory preset pulse repetition rate defined by the T0 to T4 time interval has been achieved. While the duration of the T3 to T4 time interval will vary, the microprocessor will maintain the T0 to T4 time interval constant.

The FIG. 18 table entitled "Gap On/Off Timing" represents a simplified summary of the configuration of Gap 1 and Gap 2 during the four relevant operating time intervals. The configuration "off" represents the high impedance, non-ionized spark gap state while the configuration "on" represents the ionized state where the spark gap breakdown voltage has been reached.

Figure 19:
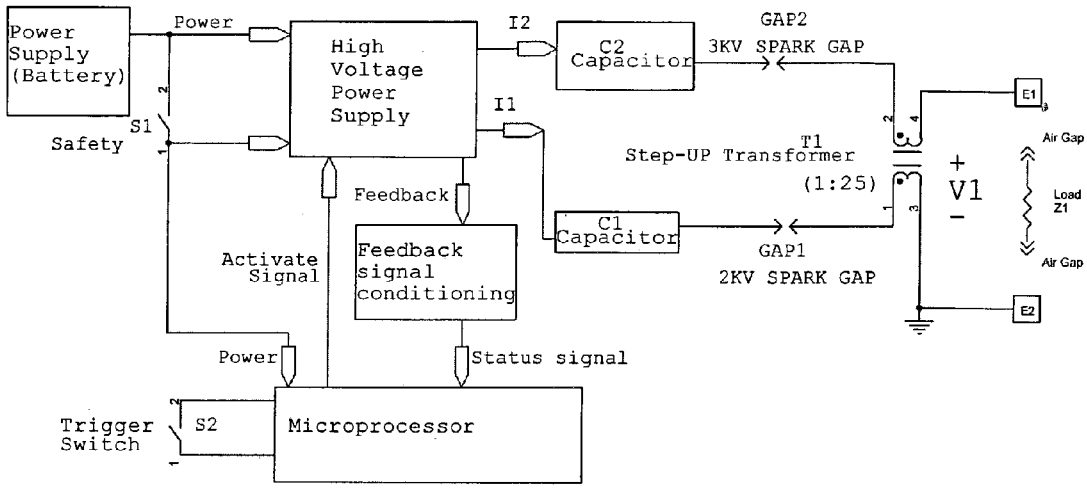
FIG. 19 represents an alternative embodiment of the invention which includes only a pair of output capacitors C1 and C2.

FIG. 19 represents a simplified block diagram of a circuit analogous to the FIG. 10 circuit except that the circuit has been simplified to include only capacitors C1 and C2. The FIG. 19 circuit is capable of operating in a highly efficient or "tuned" dual mode configuration according to the teachings of the present invention.

Figure 20:
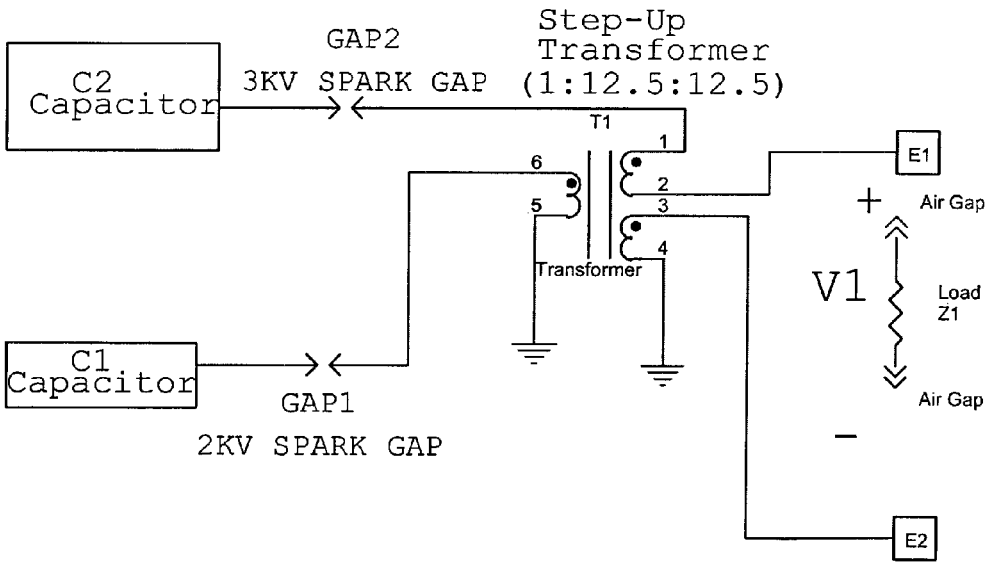
FIG. 20 represents another embodiment of the invention including an alternative output transformer designer having a single primary winding and a pair of secondary windings.

FIG. 20 illustrates an alternative configuration for coupling capacitors C1 and C2 to the stun gun output electrodes E1 and E2 via an output transformer having a single primary winding and a center-tapped or two separate secondary windings. The step up ratio relative to each primary winding and each secondary winding represents a ratio of one to 12.5. This modified output transformer still accomplishes the objective of achieving a twenty-five to one step-up ratio for generating an approximate fifty thousand volt signal with a two thousand volt power supply rating. One advantage of this double secondary transformer configuration is that the maximum voltage applied to each secondary winding is reduced by fifty percent. Such reduced secondary winding operating potentials may be desired in certain conditions to achieve a higher output voltage with a given amount of transformer insulation or for placing less high voltage stress on the elements of the output transformer.

Figure 1:
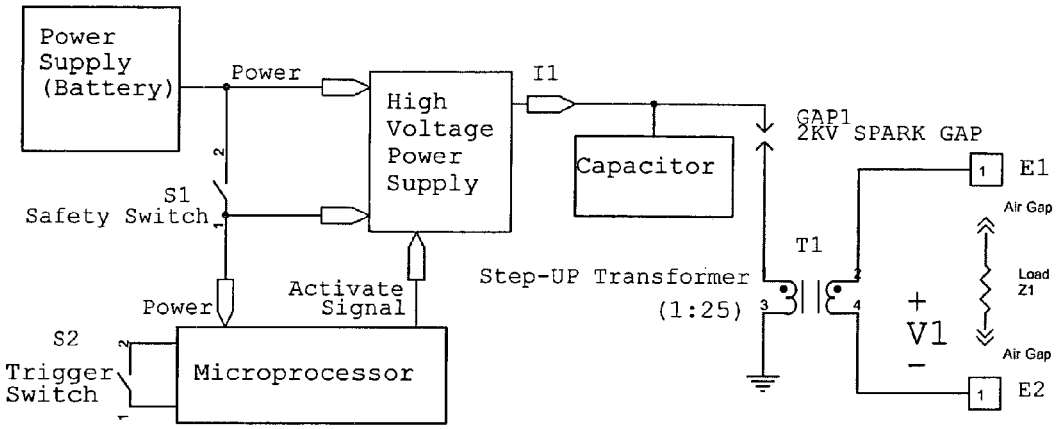
FIG. 1 illustrates a high performance prior art stun gun circuit.

Substantial and impressive benefits may be achieved by using the electronic disabling device of the present invention which provides for dual mode operation to generate a time-sequenced, shaped voltage output waveform in comparison to the most advanced prior art stun gun represented by the Taser M26 stun gun as illustrated and described in connection with the FIG. 1 block diagram.

The Taser M26 stun gun utilizes a single energy storage capacitor having a 0.88 microFarad capacitance rating. When charged to two thousand volts, that 0.88 microFarad energy storage capacitor stores and subsequently discharges 1.76 Joules of energy during each output pulse. For a standard pulse repetition rate of fifteen pulses per second with an output of 1.76 Joules per discharge pulse, the Taser M26 stun gun requires around thirty-five watts of input power which, as explained above, must be provided by a large, relatively heavy battery power supply utilizing eight series-connected AA alkaline battery cells.

For one embodiment of the electronic disabling device of the present invention which generates a time-sequenced, shaped voltage output waveform and with a C1 capacitor having a rating of 0.07 microFarads and a single capacitor C2 with a capacitance of 0.01 microFarads (for a combined rating of 0.08 microFarads), each pulse repetition consumes only 0.16 Joules of energy. With a pulse repetition rate of 15 pulses per second, the two capacitors consume battery power of only 2.4 watts at the capacitors (roughly 3.5 to 4 watts at the battery), a ninety percent reduction, compared to the twenty-six watts consumed by the state of the art Taser M26 stun gun. As a result, this particular configuration of the electronic disabling device of the present invention which generates a time-sequenced, shaped voltage output waveform can readily operate with only a single AA battery due to its 2.4 watt power consumption.

Figure 3A:
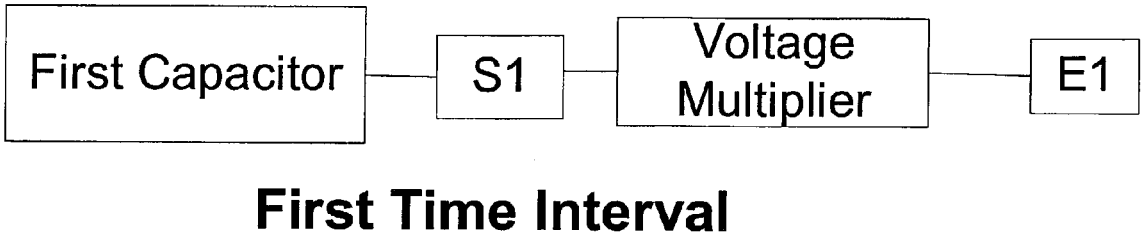
FIG. 3A represents a block diagram illustration of a first segment of the system block diagram illustrated in FIG. 2 which functions during a first time interval.
Figure 3B:
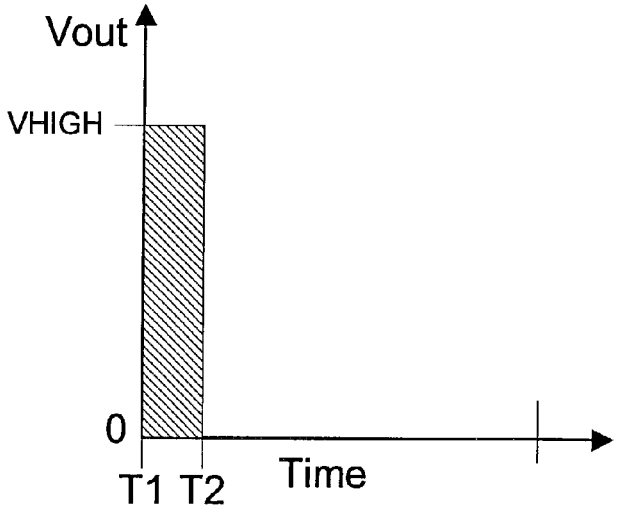
FIG. 3B represents a graph illustrating a generalized output voltage waveform of the circuit element shown in FIG. 3A.

Because the electronic disabling device of the present invention generates a time-sequenced, shaped voltage output waveform as illustrated in the FIG. 3B and FIG. 4B timing diagrams, the output waveform of this invention is tuned to most efficiently accommodate the two different load configurations presented: a high voltage output operating mode during the high impedance T1 to T2 first operating interval and, a relatively low voltage output operating mode during the low impedance second T2 to T3 operating interval.

Figure 4A:
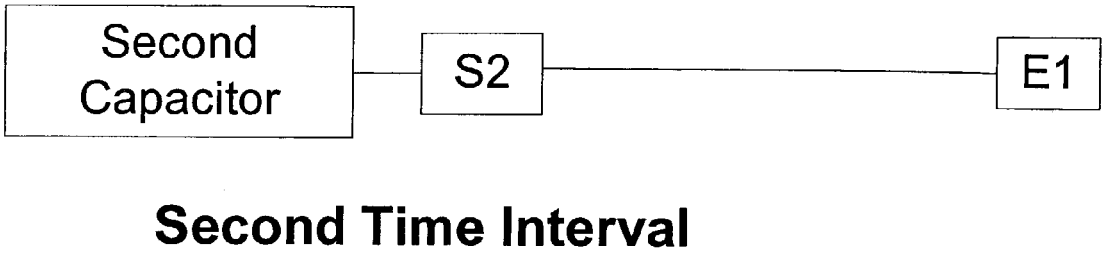
FIG. 4A illustrates a second element of the FIG. 2 system block diagram which operates during a second time interval.

As illustrated in the FIG. 5C timing diagram and in the FIG. 2, 3A and 4A simplified schematic diagrams, the circuit of the present invention is selectively configured into a first operating configuration during the T1 to T2 time interval where a first capacitor operates in conjunction with a voltage multiplier to generate a very high voltage output signal sufficient to breakdown the high impedance target-related air gap as illustrated in FIG. 5A. Once that air gap has been transformed into a low impedance configuration as illustrated in the FIG. 5C timing diagram, the circuit is selectively reconfigured into the FIG. 3A second configuration where a second or a second and a third capacitor discharge a substantial amount of current through the now low impedance target load (typically thousand Ohms or less) to thereby transfer a substantial amount of electrical charge through the target to cause massive disruption of the target's neurological control system to maximize target incapacitation.

Accordingly, the electronic disabling device of the present invention which generates a time-sequenced, shaped voltage output waveform is automatically tuned to operate in a first circuit configuration during a first time interval to generate an optimized waveform for attacking and eliminating the otherwise blocking high impedance air gap and is then returned to subsequently operate in a second circuit configuration to operate during a second time interval at a second much lower optimized voltage level to efficiently maximize the incapacitation effect on the target's skeletal muscles. As a result, the target incapacitation capacity of the present invention is maximized while the stun gun power consumption is minimized.

As an additional benefit, the circuit elements operate at lower power levels and lower stress levels resulting in either more reliable circuit operation and can be packaged in a much more physically compact design. In a laboratory prototype embodiment of a stun gun incorporating the present invention, the prototype size in comparison to the size of present state of the art Taser M26 stun gun has been reduced by approximately fifty percent and the weight has been reduced by approximately sixty percent.

It will be apparent to those skilled in the art that the disclosed electronic disabling device for generating a time-sequenced, shaped voltage output waveform may be modified in numerous ways and may assume many embodiments other than the preferred forms specifically set out and described above. Accordingly, it is intended by the appended claims to cover all such modifications of the invention which fall within the true spirit and scope of the invention.

I claim:

1. An electronic disabling device for disabling a target comprising:

a. first and second electrodes that establish first and second spaced apart points in or near the target wherein a gap exists between at least one of the electrodes and the target; and b. a high voltage power supply comprising an output circuit for switching into and operating in a first output circuit configuration to generate a first higher voltage output across the first and second electrodes during a first time interval to ionize air within the gap and to enable a current across the gap and for subsequently switching into and operating in a second output circuit configuration to generate a second lower voltage output across the first and second electrodes during a second time interval to maintain the current through the target thereby producing involuntary muscle contractions that disable the target;

c. wherein the first output circuit configuration comprises:

(1) a first energy storage capacitor having a first voltage across the first energy storage capacitor;

(2) a voltage multiplier coupled between the first energy storage capacitor and the gap for providing a multiplied voltage across the gap higher than the first voltage; and (3) a first switch operated after the first voltage reaches a first magnitude and operated to release energy from the first energy storage capacitor to generate the first higher voltage output through the voltage multiplier to ionize air in the gap; and d. wherein the second output circuit configuration comprises:

(1) a second energy storage capacitor; and (2) a second switch operated after operation of the first switch and operated to release energy from the second energy storage capacitor to generate the second lower voltage output not multiplied by the voltage multiplier to maintain the current through the target.

2. The electronic disabling device of claim 1 wherein the first switch decouples the first energy storage capacitor from the gap after the second switch begins generating the second lower voltage output.

3. The electronic disabling device of claim 1 wherein the second switch interrupts the current after the second energy storage capacitor discharges to a predetermined voltage magnitude.

4. The electronic disabling device of claim 1 wherein at least one of the first and second switches comprise a voltage activated switch.

5. The electronic disabling device of claim 1 wherein the first switch comprises a first spark gap having a first breakdown voltage and the second switch comprises a second spark gap having a second breakdown voltage greater than the first breakdown voltage.

6. The electronic disabling device of claim 1 wherein the first energy storage capacitor has substantially greater capacitance than the second energy storage capacitor.

7. The electronic disabling device of claim 3 further comprising a controller for generating a series of pulses of the current having a pulse repetition rate by disabling the high voltage power supply for each respective period between pulses of the series beginning about the time the current is interrupted and extending for a respective duration in accordance with a respective duration of operation in the second output circuit configuration preceding interruption of the current.

8. The electronic disabling device of claim 7 wherein disabling the which voltage lower supply comprises disabling charging the first energy storage capacitor.

9. The electronic disabling device of claim 1 wherein the voltage multiplier comprises a step-up transformer.

10. The electronic disabling device of claim 9 wherein a secondary winding of the step-up transformer is coupled in series with the discharge path of the second energy storage capacitor.

11. The electronic disabling device of claim 1 wherein operation of the first switch is for a period of about 1.5 microseconds.

12. The electronic disabling device of claim 1 wherein the first magnitude is about 2000 volts.

13. The electronic disabling device of claim 1 wherein the second energy storage capacitor has a capacitance less than or about 0.02 microfarads.

14. The electronic disabling device of claim 4 wherein the activation voltage of the first switch is less than the activation voltage of the second switch.

15. The electronic disabling device of claim 1 wherein the first energy storage capacitor has a capacitance less than or about 0.14 microfarads.

16. The electronic disabling device of claim 1 wherein the second switch enables generating the second lower voltage output for about 50 microseconds.

17. The electronic disabling device of claim 5 wherein the second breakdown voltage is substantially greater than a voltage across the second energy storage capacitor.

18. The electronic disabling device of claim 14 wherein the first activation voltage is about 2000 volts and the second activation voltage is about 3000 volts.

19. The electronic disabling device of claim 1 wherein the first energy storage capacitor stores less than or about 0.28 joules.

20. The electronic disabling device of claim 1 wherein the second energy storage capacitor stores less than or about 0.04 joules.

21. The electronic disabling device of claim 1 wherein an energy stored by the first energy storage capacitor is about 7 times an energy stored by the second energy storage capacitor.

22. The electronic disabling device of claim 1 wherein a ratio of a duration of operation in the second output circuit configuration and a duration of operation in the first output circuit configuration is about 33.

23. A method for disabling a target comprising:

a. charging a first and a second energy storage capacitor during a first time interval;

b. coupling the first energy storage capacitor to a voltage multiplier when a voltage across the first energy storage capacitor exceeds a voltage threshold;

c. discharging the first energy storage capacitor through the voltage multiplier during a second time interval to generate a multiplied voltage across a first and a second electrode;

d. positioning the first and second electrodes in or near the target wherein a high impedance air gap exists between at least one of the positioned electrodes and the target;

e. establishing a reduced impedance ionized pathway across the air gap; and f. in response to the multiplied voltage, coupling the second energy storage capacitor to the first and second electrodes and not multiplied by the voltage multiplier to provide a current through the ionized air gap, the target, and the first and second electrodes during a third time interval.

24. The method of claim 23 wherein charging is completed when the first and second energy storage capacitors are charged to substantially equal voltage magnitudes during the first time interval.

25. The method of claim 23 wherein a capacitance of the first energy storage capacitor substantially exceeds a capacitance of the second energy storage capacitor.

26. The method of claim 23 wherein the voltage multiplier comprises a step-up transformer comprising a primary winding and a secondary winding and wherein a discharge current from the first energy storage capacitor passes through the primary winding.

27. The method of claim 23 wherein the multiplied voltage substantially exceeds the voltage threshold.

28. The method of claim 23 wherein a duration of the second time interval is substantially shorter than a duration of the third time interval.

29. The method of claim 23 wherein coupling the first energy storage capacitor comprises using a first spark gap having a first breakdown voltage substantially equal to the voltage threshold.

30. The method of claim 29 wherein coupling the second energy storage capacitor comprises using a second spark gap having a second breakdown voltage greater than the first breakdown voltage.

31. The method of claim 23 wherein positioning the first and second output electrodes comprises propelling respective lengths of wire that each span a distance toward the target.

32. An apparatus for impeding locomotion by a target, the apparatus for use with a provided electrode for conducting a current through the target, the apparatus comprising:

a step-up transformer comprising a primary winding and a secondary winding, the electrode coupled to receive energy for the current from the secondary winding;

a first capacitance that discharges through the primary winding to provide energy for the current so that the current establishes an arc in series between the electrode and the target; and a second capacitance that discharges through the secondary winding to provide energy for the current through the established arc; wherein the first capacitance discharges for a first period;

the second capacitance discharges for a second period greater than the first period; and the current produces contractions in skeletal muscles of the target to impede locomotion by the target.

33. The apparatus of claim 32 wherein the first period is about 1.5 microseconds.

34. The apparatus of claim 32 wherein the second period is about 50 microseconds.

35. The apparatus of claim 32 wherein a ratio of the second period to the first period is about 33.

36. The apparatus of claim 32 further comprising a switch, in series between the second capacitance and the secondary winding, that operates to discharge the second capacitance.

37. The apparatus of claim 36 wherein the switch operates in response to discharging of the first capacitance through the primary winding.

38. The apparatus of claim 36 wherein the switch operates in response to a voltage of the secondary winding.

39. The apparatus of claim 32 further comprising a first spark gap in series between the second capacitance and the secondary winding that conducts to discharge the second capacitance.

40. The apparatus of claim 32 further comprising a voltage activated switch, in series between the second, capacitance and the secondary winding, that operates to discharge the second capacitance, wherein the activation voltage is greater than a voltage across the second capacitance.

41. The apparatus of claim 32 wherein:

the first capacitance discharges a first quantity of energy through the primary winding; and the second capacitance discharges a second quantity of energy through the secondary winding less than the first quantity.

42. The apparatus of claim 41 wherein the first quantity is less than or about 0.28 joules.

43. The apparatus of claim 41 wherein the second quantity is less than or about 0.04 joules.

44. The apparatus of claim 41 wherein a ratio of the first quantity to the second quantity is about 7.

45. The apparatus of claim 32 wherein the first capacitance comprises less than or about 0.14 microfarads.

46. The apparatus of claim 32 wherein the second capacitance comprises less than or about 0.02 microfarads.

47. An apparatus for impeding locomotion by a target, the apparatus for use with a provided electrode for conducting a current through the target, the apparatus comprising:

a step-up transformer comprising a primary winding and a secondary winding, the electrode coupled to receive enemy for the current from the secondary winding;

a first capacitance that discharges through the primary winding to provide energy for the current so that the current establishes an arc in series between the electrode and the target; and a second capacitance that discharges through the secondary winding to provide energy for the current through the established arc;

a first spark gap in series between the first capacitance and the primary winding; and a second spark gap in series between the second capacitance and the secondary winding that conducts to discharge the second capacitance; wherein the second spark gap has a breakdown voltage greater than a breakdown voltage of the first spark gap; and the current produces contractions in skeletal muscles of the target to impede locomotion by the target.

48. The apparatus of claim 47 wherein the first breakdown voltage is about 2000 volts.

49. The apparatus of claim 47 wherein the second breakdown voltage is about 3000 volts.

50. An apparatus for impeding locomotion by a target, the apparatus for use with a provided first electrode and a provided second electrode, the first and second electrodes for conducting a current through the target, the apparatus comprising:

a step-up transformer comprising a primary winding, a first secondary winding, and a second secondary winding, the first electrode coupled to receive energy for the current from the first secondary winding, the second electrode coupled to receive energy for the current from the second secondary winding;

a first capacitance that discharges through the primary winding to provide energy for the current so that the current establishes an arc in series between at least one of the first and second electrodes and the target; and a second capacitance that discharges through the first secondary winding to provide energy for the current through the established arc; wherein the first capacitance discharges for a first period;

the second capacitance discharges for a second period greater than the first period; and the current produces contractions in skeletal muscles of the target to impede locomotion by the target.

51. The apparatus of claim 50 wherein the first period is about 1.5 microseconds.

52. The apparatus of claim 50 wherein the second period is about 50 microseconds.

53. The apparatus of claim 50 wherein a ratio of the second period to the first period is about 33.

54. The apparatus of claim 50 further comprising a switch in series between the second capacitance and the first secondary winding that conducts to discharge the second capacitance.

55. The apparatus of claim 54 wherein the switch closes in response to discharging of the first capacitance through the primary winding.

56. The apparatus of claim 54 wherein the switch closes in response to a voltage of the secondary winding.

57. The apparatus of claim 50 further comprising a first spark gap in series between the second capacitance and the secondary winding that conducts to discharge the second capacitance.

58. The apparatus of claim 50 further comprising a voltage activated switch, in series between the second capacitance and the secondary winding, that operates to discharge the second capacitance, wherein the activation voltage is greater than a voltage across the second capacitance.

59. The apparatus of claim 50 wherein:

the first capacitance discharges a first quantity of energy through the primary winding; and the second capacitance discharges a second quantity of energy through the first secondary winding less than the first quantity.

60. The apparatus of claim 59 wherein the first quantity is less than or about 0.28 joules.

61. The apparatus of claim 59 wherein the second quantity is less than or about 0.04 joules.

62. The apparatus of claim 59 wherein a ratio of the first quantity to the second quantity is about 7.

63. The apparatus of claim 50 wherein the first capacitance comprises less than or about 0.14 microfarads.

64. The apparatus of claim 50 wherein the second capacitance comprises less than or about 0.02 microfarads.

65. An apparatus for impeding locomotion by a target, the apparatus for use with a provided first electrode and a provided second electrode, the first and second electrodes for conducting a current through the target, the apparatus comprising:

a step-up transformer comprising a primary winding, a first secondary winding, and a second secondary winding, the first electrode coupled to receive energy for the current from the first secondary winding, the second electrode coupled to receive energy for the current from the second secondary winding;

a first capacitance that discharges through the primary winding to provide energy for the current so that the current establishes an arc in series between at least one of the first and second electrodes and the target;

a second capacitance that discharges through the first secondary winding to provide energy for the current through the established arc:

a first spark gap in series between the first capacitance and the primary winding; and a second spark gap in series between the second capacitance and the secondary winding that conducts to discharge the second capacitance; wherein the second spark gap has a breakdown voltage greater than a breakdown voltage of the first spark gap; and the current produces contractions in skeletal muscles of the target to impede locomotion by the target.

66. The apparatus of claim 65 wherein the first breakdown voltage is about 2000 volts.

67. The apparatus of claim 65 wherein the second breakdown voltage is about 3000 volts.

68. An apparatus for impeding locomotion by a target, the apparatus for use with a provided electrode for conducting a current through the target, the apparatus comprising:

a first capacitance that discharges to provide energy for the current so that the current establishes an arc in series between the electrode and the target;

a second capacitance that discharges to provide energy for the current through the established arc;

a first switch that operates to discharge the first capacitance; and a second switch that operates to discharge the second capacitance in response to discharging of the first capacitance; wherein the second capacitance is not substantially discharged without operation of the second switch, and wherein;

the first capacitance discharges for a first period;

the second capacitance discharges for a second period greater than the first period; and the current produces contractions in skeletal muscles of the target to impede locomotion by the target.

69. The apparatus of claim 68 wherein the first period is about 1.5 microseconds.

70. The apparatus of claim 68 wherein the second period is about 50 microseconds.

71. The apparatus of claim 68 wherein a ratio of the second period to the first period is about 33.

72. The apparatus of claim 68 wherein the second switch operates in response to a multiplied voltage of the first capacitance.

73. The apparatus of claim 68 wherein the second switch comprises a first spark gap that conducts to discharge the second capacitance.

74. The apparatus of claim 68 wherein the first capacitance comprises less than or about 0.14 microfarads.

75. The apparatus of claim 68 wherein the second capacitance comprises less than or about 0.02 microfarads.

76. An apparatus for impeding locomotion by a target, the apparatus for use with a provided electrode for conducting a current through the target, the apparatus comprising:

a first capacitance that discharges to provide energy for the current so that the current establishes an arc in series between the electrode and the target;

a second capacitance that discharges to provide energy for the current through the established arc:

a first switch, comprising a first spark gap, that operates to discharge the first capacitance; and a second switch, comprising a second spark gap, that operates to discharge the second capacitance in response to discharging of the first capacitance, the second capacitance not substantially discharged without operation of the second switch; wherein the second spark gap has a breakdown voltage greater than a breakdown voltage of the first spark gap; and the current produces contractions in skeletal muscles of the target to impede locomotion by the target.

77. The apparatus of claim 76 wherein the first breakdown voltage is about 2000 volts.

78. The apparatus of claim 76 wherein the second breakdown voltage is about 3000 volts.

79. A method performed by a weapon for impeding locomotion by a target by passing a current through the target, the method comprising:

discharging a first capacitance to provide energy for ionizing air between an electrode of the weapon and the target;

after beginning discharging of the first capacitance, operating a switch for discharging a second capacitance to provide energy for the current through the ionized air, the second capacitance not substantially discharged without operating the switch; wherein discharging the first capacitance comprises discharging for a first period;

discharging the second capacitance comprises discharging for a second period greater than the first period; and the current passes through the target for impeding locomotion by the target.

80. The method of claim 79 wherein the first period is about 1.5 microseconds.

81. The method of claim 79 wherein the second period is about 50 microseconds.

82. The method of claim 79 wherein a ratio of the second period to the first period is about 33.

83. An apparatus for impeding locomotion by a target, the apparatus for use with a provided electrode for conducting a current through the target, the apparatus comprising:

a first capacitance that discharges to provide energy for the current so that the current establishes an arc in series between the electrode and the target;

a second capacitance that discharges to provide energy for the current through the established arc;

a first switch that operates to discharge the first capacitance; and a second switch that operates to discharge the second capacitance in response to discharging of the first capacitance; wherein the second capacitance is not substantially discharged without operation of the second switch;

the second switch comprises a voltage activated switch that operates to discharge the second capacitance, wherein;

the activation voltage is greater than a voltage across the second capacitance; and the current produces contractions in skeletal muscles of the target to impede locomotion by the target.

84. An apparatus for impeding locomotion by a target, the apparatus for use with a provided electrode for conducting a current through the target, the apparatus comprising:

a first capacitance that discharges to provide energy for the current so that the current establishes an arc in series between the electrode and the target;

a second capacitance that discharges to provide energy for the current through the established arc;

a first switch that operates to discharge the first capacitance; and a second switch that operates to discharge the second capacitance in response to discharging of the first capacitance; wherein the second capacitance is not substantially discharged without operation of the second switch;

the first capacitance discharges a first quantity of energy to establish the arc;

the second capacitance discharges a second quantity of energy to impede locomotion by the target, the second quantity being less than the first quantity; and the current produces contractions in skeletal muscles of the target to impede locomotion by the target.

85. The apparatus of claim 84 wherein the first quantity is less than or about 0.28 joules.

86. The apparatus of claim 84 wherein the second quantity is less than or about 0.04 joules.

87. The apparatus of claim 84 wherein a ratio of the first quantity to the second quantity is about 7.

88. A method performed by a weapon for impeding locomotion by a target by passing a current through the target, the method comprising:

discharging a first capacitance, through a voltage multiplies to provide energy at a multiplied voltage for ionizing air between an electrode of the weapon and the target; and after beginning discharging of the first capacitance, operating a switch for discharging a second capacitance to provide energy for the current through the ionized air, the second capacitance not substantially discharged without operating the switch, the current passing through the target for impeding locomotion by the target.

89. The method of claim 88 wherein discharging the second capacitance is performed not through the voltage multiplier.

90. The method of claim 88 wherein the voltage multiplier comprises a step-up transformer.

91. The method of claim 90 wherein discharging the second capacitance comprises discharging the second capacitance through a secondary winding of the transformer.

92. The method of claim 91 wherein the switch operates in response to a voltage of the secondary winding.

93. The method of claim 90 further comprising conducting the current through a second electrode coupled to a second secondary winding of the transformer.

94. The method of claim 90 wherein:

discharging the first capacitance comprises discharging through a first spark gap in series between the first capacitance and a primary winding of the transformer;

discharging the second capacitance comprises discharging through a second spark gap in series between the second capacitance and a secondary winding of the transformer, the switch comprising the second spark gap; and the second spark gap has a breakdown voltage greater than a breakdown voltage of the first spark gap.

95. The method of claim 90 wherein:

discharging the first capacitance comprises discharging a first quantity of energy through a primary winding of the transformer;

discharging the second capacitance comprises discharging a second quantity of energy through a secondary winding; and the second quantity is less than the first quantity.

96. The method of claim 94 wherein the first breakdown voltage is about 2000 volts.

97. The method of claim 94 wherein the second breakdown voltage is about 3000 volts.

98. The method of claim 95 wherein the first quantity is less than or about 0.28 joules.

99. The method of claim 95 wherein the second quantity is less than or about 0.04 joules.

100. The method of claim 95 wherein a ratio of the first quantity to the second quantity is about 7.

101. The method of claim 88 wherein:

the method further comprises charging the second capacitance to provide a voltage across the second capacitance;

discharging the second capacitance comprises discharging through a voltage activated switch, the switch comprising the voltage activated switch; and the activation voltage is greater than the voltage across the second capacitance.

102. The method of claim 88 further comprising propelling the electrode toward the target.

103. The method of claim 88 further comprising:

charging the first capacitance to provide a first voltage across the first capacitance; and charging the second capacitance to provide a second voltage across the second capacitance different from the first voltage.

104. The method of claim 88 wherein discharging the second capacitance comprises discharging through the switch.

105. The method of claim 88 wherein the switch operates in response to discharging the first capacitance.

106. The method of claim 88 wherein discharging the second capacitance comprises discharging through a spark gap, the switch comprising the spark gap.

107. The method of claim 88 wherein the first capacitance comprises less than or about 0.14 microfarads.

108. The method of claim 88 wherein the second capacitance comprises less than or about 0.02 microfarads.

* * * * *

UNITED STATES PATENT AND TRADEMARK OFFICE

CERTIFICATE OF CORRECTION

PATENT NO. : 7,145,762 B2
APPLICATION NO. : 10/364164
DATED : December 5, 2006
INVENTOR(S) : Nerheim It is certified that error appears in the above-identified patent and that said Letters Patent is hereby corrected as shown below:

Col. 10, line 64, change “which” to --high--;

Col. 10, line 64, change “lower” to --power--;

Col. 13, line 22, change “enemy” to --energy--;

Col. 17, line 8-9, change “multiplies” to --multiplier--;

Signed and Sealed this

Thirteenth Day of February, 2007

JON W. DUDAS
*Director of the United States Patent and Trademark Office*